United States Patent [19]

Heim et al.

[11] Patent Number: 4,770,343

[45] Date of Patent: Sep. 13, 1988

[54] RESILIENT RAIL FIXING DEVICE FOR TRACK INSTALLATIONS

[75] Inventors: Armin Heim, Kreuzlingen, Switzerland; Siegfried Keusch, Plochingen; Karl H. Schwiede, Daisendorf, both of Fed. Rep. of Germany

[73] Assignees: Schwihag GmbH, Tagerwilen, Switzerland; Karl Richtberg GmbH & Co. KG, Bingen, Fed. Rep. of Germany

[21] Appl. No.: 42,629

[22] Filed: Apr. 23, 1987

Related U.S. Application Data

[63] Continuation of Ser. No. 887,976, Jul. 24, 1986, abandoned, which is a continuation of Ser. No. 688,378, Jan. 2, 1985, abandoned.

[30] Foreign Application Priority Data

Jan. 4, 1984 [DE] Fed. Rep. of Germany ..... 3400110

[51] Int. Cl.[4] ..... E01B 9/30

[52] U.S. Cl. ..... 238/349; 238/351

[58] Field of Search ..... 238/310, 349, 351

[56] References Cited

U.S. PATENT DOCUMENTS

| | | | |
|---|---|---|---|
| 3,658,247 | 4/1972 | Serafin et al. | 238/349 |
| 3,690,551 | 9/1972 | Munch | 238/349 |
| 3,986,667 | 10/1976 | Heim | 238/349 |
| 4,452,392 | 6/1984 | Rajaram et al. | 238/349 |

FOREIGN PATENT DOCUMENTS

| | | | |
|---|---|---|---|
| 194882 | 5/1957 | Austria . | |
| 231492 | 6/1963 | Austria . | |
| 1102791 | 3/1961 | Fed. Rep. of Germany | 238/349 |
| 1188637 | 3/1965 | Fed. Rep. of Germany . | |
| 2107374 | 9/1971 | Fed. Rep. of Germany | 238/349 |
| 2211164 | 9/1973 | Fed. Rep. of Germany . | |
| 2740144 | 3/1979 | Fed. Rep. of Germany . | |
| 3003881 | 8/1981 | Fed. Rep. of Germany . | |
| 3003867 | 9/1981 | Fed. Rep. of Germany . | |
| 1217531 | 12/1970 | United Kingdom . | |

*Primary Examiner*—Robert B. Reeves
*Assistant Examiner*—Donald T. Hajec
*Attorney, Agent, or Firm*—Stevens, Davis, Miller & Mosher

[57] ABSTRACT

A resilient rail fixing device for track installations with good torsional resistance and positive lateral hold for the rail has a design whih ensures the straightforward production of the clamp clips (3) and the secure co-operation of the clamp clips (3) with the anchoring parts (1,2). The clamp clip (3) is produced as a flexible moulding of cold-bendable steel and has four resilient rod sections (31', 34' and 31'', 34'') as abutment legs (3' and 3''). Each bracing part (26', 26'') of the clamp clip (3) is shaped integrally onto two independent resilient rod secions (31' and 34' or 31' and 34'') which have been stressed to torsion. Two inner resilient rod sections (31' and 31'') are produced integrally with a transverse connecting piece (33), while the two outer resilient rod sections (34' and 34'') are supportd by U-Shaped deflections (35' and 35'') on the top of the transverse connecting piece (33).

22 Claims, 13 Drawing Sheets

30"
30'
27"
27'
XII
25
33"
33'
29"
29'
26"
28"
28'
26'
31"
31
3"
3'
34"
34'
33
32"
32'
36"
36'
3
35"
35'
25

3
30'
36'
25
36"
30"
26'
27'
27"
26"
29'
28'
34'
31'
33
25
31"
34"
28"
29"

RESILIENT RAIL FIXING DEVICE FOR TRACK INSTALLATIONS

This application is a continuation of application Ser. No. 887,976 filed July 24, 1986, which is a continuation of application Ser. No. 688,378 Filed Jan. 2, 1985, both now abandoned.

This invention relates to a resilient rail fixing device for track installations with good torsional resistance and positive lateral hold, comprising anchoring parts arranged parallel to both longitudinal edges of the rail foot on the top of sleepers or other rail support points and clamp clips, the anchoring parts and the clamp clips being designed symmetrically about a common vertical plane and the clamp clips having, on the one hand, two bracing sections, mirror-images of each other, which may each be placed onto the rail foot directly adjacent to the anchoring parts, and having, on the other hand, connected to each of these bracing sections an abutment leg which is supportable on the anchoring parts and provided with a transverse piece forming an integral connection between the regions of symmetry and provided with contact members for fixing the position in relation to the anchoring parts, while the anchoring parts have not only support guides for the abutment legs, but also notches for the contact members of the clamp clips, and the rail is provided with a curve on the rail foot between the vertical outer surface of the foot and the connecting top surface of the foot, which is preferably inclined towards the horizontal.

Various examples of resilient rail fixing devices for track installations as described above are already known, for example from GB No. 1,217,531 and DE-AS No. 22 11 164.

These known rail fixing devices suffer from the disadvantage that the clamp clips have a precisely defined position in relation to the rail foot and to the anchoring parts only in their final assembly position. Also, these clamp clips have to be produced from bars with a relatively large cross-section in order to produce the required high holding-down force; this material can only be shaped when heated because of its high bending resistance and therefore the clamp clips are very expensive to produce.

As disclosed, for example, in DE-OS No. 30 03 867 and DE-OS No. 30 03 881, resilient rail fixing devices for track installations are known in which the clamp clips can take up a precisely defined final assembly position, but also a positionally-ensured pre-assembly position and an equally positionally-ensured neutralising position, in relation to the rail foot and to the anchoring parts.

However, even in this case, the clamp clips used result in substantial production costs as they are produced from resilient flat material, particularly flat steel sheet, and therefore can only be shaped in a heated state.

Thus, an object of at least one embodiment of the invention is to provide a resilient rail fixing device for track installations of the type initially described, in which the clamp clips, designed to produce a high loading or pre-stressing force of about 1.5 Mp, can be produced with minimal technical expenditure, and in which the remaining functional parts, particularly the anchoring parts and/or bearing plates are of a design which permits the straightforward insertion of the clamp clips, this being ensured not only by the positional certainty of the precisely defined final assembly position but also by fixing in a pre-assembly position and neutralizing position.

Accordingly, the invention provides a resilient rail fixing device for track installations with good torsional resistance and positive lateral hold,comprising clamp clips and anchoring parts, arranged parallel to both longitudinal edges of the rail foot on the top of sleepers or other rail support points, the anchoring parts and the clamp clips being symmetrical about a common vertical plane and the clamp clips being provided on the one hand, with two bracing sections, mirror images of each other, each of which may be placed on the rail foot directly adjacent to the anchoring parts, having, on the other hand, an abutment leg which may be supported on the anchoring parts and joined to each of these bracing sections, and is also provided with a transverse piece which forms the integral connection between their regions of symmetry, and with contact members which fix the position in relation to the anchoring parts, while the anchoring parts have not only support guides for the abutment legs but also notches for the contact members of the clamp clips and the rail on the rail foot between the vertical outside of the foot and the joining top surface of the foot, preferably inclined towards the horizontal, is provided with a curve, characterised in that each abutment leg of the clamp clip forms a torsion leg which comprises two at least approximately parallel adjacent resilient rod sections, these resilient rod sections are each connected integrally by a loop which is deflected outwards and downwards at a bias to resilient rod sections and forms a bracing section, the two inner resilient rod section sections of the torsion legs run into the transverse connecting piece, the two resilient rod sections of the torsion legs have a U-shaped deflection at a spacing behind the transverse connecting piece which deflection rests with its free end section on the transverse connecting piece, the anchoring parts are provided with two support flanges projecting towards opposite sides for the torsion legs of the clamp clip, joined to a central web, and are each arranged at a spacing above the leading surfaces arranged adjacent to the rail foot for the bracing section of the clamp clip, and are also provided at the end of the central web remote from the rail foot with a leading and notched tongue for the transverse connecting piece of the clamp clip.

The design of the clamp clip according to the invention provides substantial advantages, as the division of the required total force into four individual forces acting in parallel enables a resilient rod material with a relatively small cross-section to be used for the inexpensive production of the clamp clip by cold bending and thus a weak spring characteristic can be produced by the twisting of long torsion rods. Consequently, by observing all the tolerances of the entire bracing system, there is only a relatively small deviation in force from the nominal value.

Preferably, all resilient rod sections of the torsion legs of the clamp clip are bent above their longitudinal sections positioned between the loop forming the bracing section and the connecting transverse piece.

This measure enables the clamp clips to connected easily and reliably with the anchoring parts and to be moved without difficulty between the pre-assembly position, the neutralizing position and the final assembly position. This movement of the clamp clips may be carried out manually, for example by means of a special assembly lever, but also by machine, for example by a displacement mechanism located on a line inspection vehicle.

Each of the loops forming the bracing sections of the clamp clip may be deflected downwards, in the leg regions connected to the resilient rod sections of the torsion legs, to produce the necessary ride clearance, while their outer curved section is deflected upwards to adapt the clamp clip to the radius of curvature of the rail foot.

Owing to this design of the bracing sections, the clamp clips work, with their bearing points of a substantial spacing from each other, on the rail foot and act on them in the region of the curve between the vertical outer surface of the foot and the connecting top surface of the foot which is preferably inclined towards the horizontal. A principal tension force is thereby exerted on the rail foot, which force acts from above downwards, and therefore obliquely inwardly, and is for example about 1.5 Mp. A holding force, acting vertically from above downwards, on the one hand, and a directing force, acting horizontally from outside inwards, on the other hand, are deduced from this principal tension force, in such a manner that the horizontal directing force has a value of more than half the vertical holding force.

The loops which form the bracing sections of the clamp clip may be approximately triangular in shape and either the leg which runs into the outer resilient rod section or the leg which runs into the inner resilient rod section of the same torsion leg extends substantially at right-angles to the longitudinal direction of the relevant resilient rod section, while the other leg, in each case, inclines towards the longitudinal direction of the relevant resilient rod section.

This embodiment of the clamp clip ensures that, in the final assembly position, the bracing sections of the clamp clip act upon the rail foot only above their bearing points which are at a substantial spacing from each other and thereby counter-act the twisting of the rail.

The clamp clips can be flexible formed parts of resilient steel rods which have a round, oval or polygonal cross-section, for example a square cross-section.

The free ends of the U-shaped deflection connected to the outer resilient rod sections may be inclined towards the plane of symmetry of the clamp clip and thereby rest relatively close to each other on the connecting transverse piece.

If the supporting flanges of the anchoring parts have a curve at least on their contact surface for the torsion legs of the clamp clip, the insertion of the clamp clips is made substantially easier.

The anchoring parts for the clamp clip may also comprise an angle guide plate laying on the top of a sleeper, or another rail support part, and an anchoring head, positively but detachably engaging with the angle guide plate via a central web, the angle guide plate and the anchoring head being fixed by a common rail screw or the like. The angle guide plate and the anchoring head can also be designed as a one-piece casting.

It has proved particularly effective if the central web of the anchoring parts comprise a bottom web part extending from the angle guide plate and a top web part provided below the anchoring head, a longitudinal groove being located in the web part of the angle guide plate in which the toes projecting from the web part of the anchoring head positively engage.

However, it is preferable with a rail fixing device according to the invention that the leading and notched tongue for the transverse section of the clamp clip is shaped onto the web part of the angle guide plate. Furthermore, the angle guide plate may have an approximately T-shaped section and thus have upwardly projecting support ledges at the free end of its web part and upwardly projecting rims at the free ends of its flanges, while the leading inclined surfaces are provided or formed on its base, adjacent to the central web.

The anchoring parts may comprise an anchoring head fixed, in a detachable manner, to a bearing plate resting on the top of the sleeper or another rail support point, and thereby positively engage, without risk of twisting, with at least one toe located on the central web thereof in a recess in the bearing plate.

A further design consists of fixing the bearing plate alone to the top of the sleeper or another rail support point, on both sides of the rail, by at least one rail screw or the like, while the anchoring head, together with the bearing plate, is fixable by a further rail screw or the like. The anchoring head can have arms which project laterally at least in regions at each of its support flanges, each of which arms supports a downwardly oriented web with a toe which positively engages to ensure against twisting into a recess in the bearing plate.

It has also proved effective to provide the top of the bearing plate with the projecting parts which ensure the positive lateral hold of the rail foot, and which simultaneously form the inclined surfaces for the bracing sections of the clamp clip. The projecting parts which form the inclined surfaces can be in the form of tongues bent upwards or punched from the bearing plate. The bearing plate may have a downwardly oriented deflection which serves to produce a prestressing force. The leading and notched tongue for the connecting transverse part of the clamp clip may be formed on the bearing plate. It can also be formed onto the central web of the anchoring head.

In the case of the anchoring parts for the clamp clips which are provided with angle guide plates, the angle guide plate is provided with a recess on the bottom of its inner edges, which recess forms a support contact for an intermediate layer lying on the sleeper or the like.

If the anchoring parts for the clamp clips comprise the bearing plate and the anchoring head, then the anchoring head may be provided with a recess on the bottom of the surface of the central web facing the rail foot, which recess can form a support contact for an intermediate layer or plate laying on the bearing plate.

Preferred embodiments of the invention are described in detail in the following, by example only, with reference to the accompanying drawings wherein.

Figure 1:
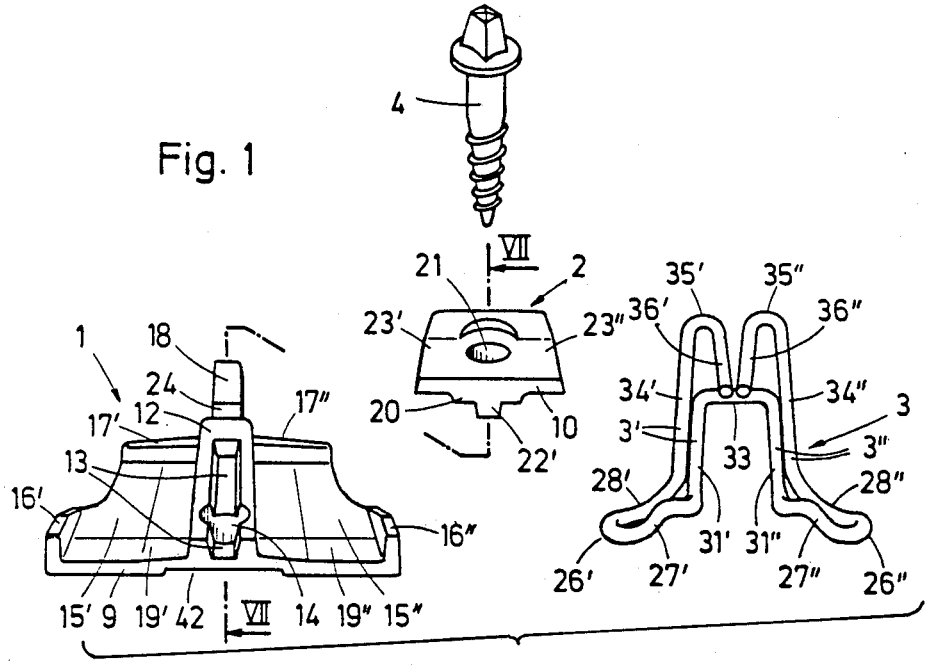
FIG. 1 is exploded view showing the individual components of a first embodiment of a resilient rail fixing device for track installations.
Figure 2:
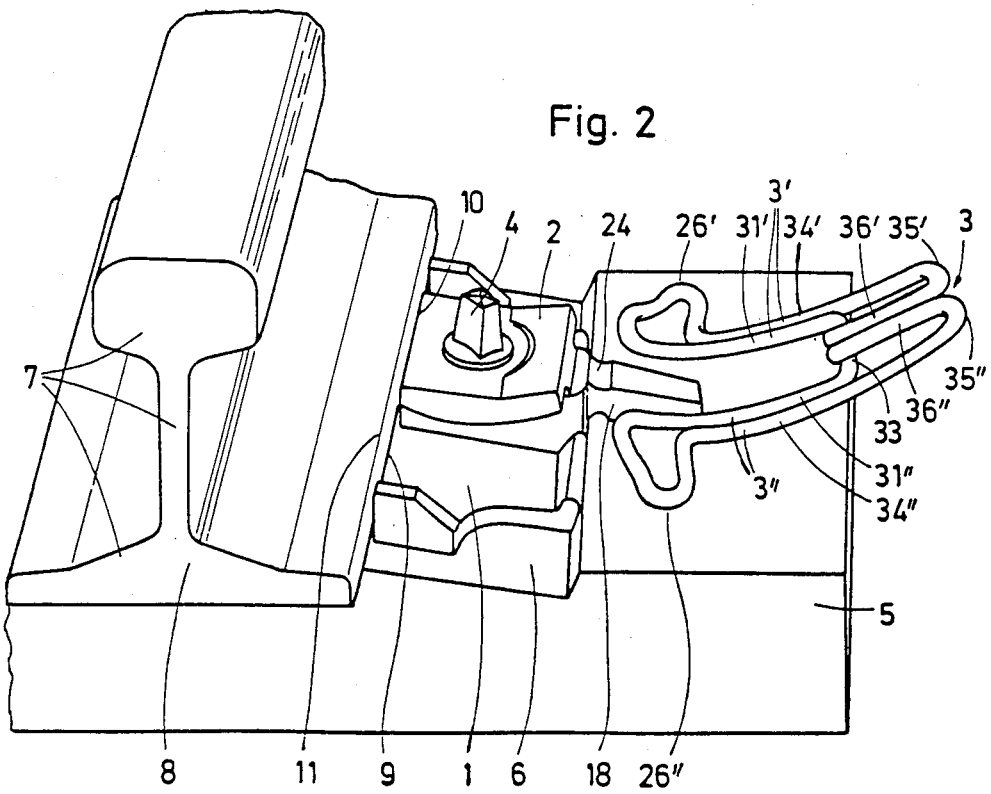
FIG. 2 is a perspective view showing the resilient rail fixing device according to FIG. 1 when partially assembled on a sleeper.
Figure 3:
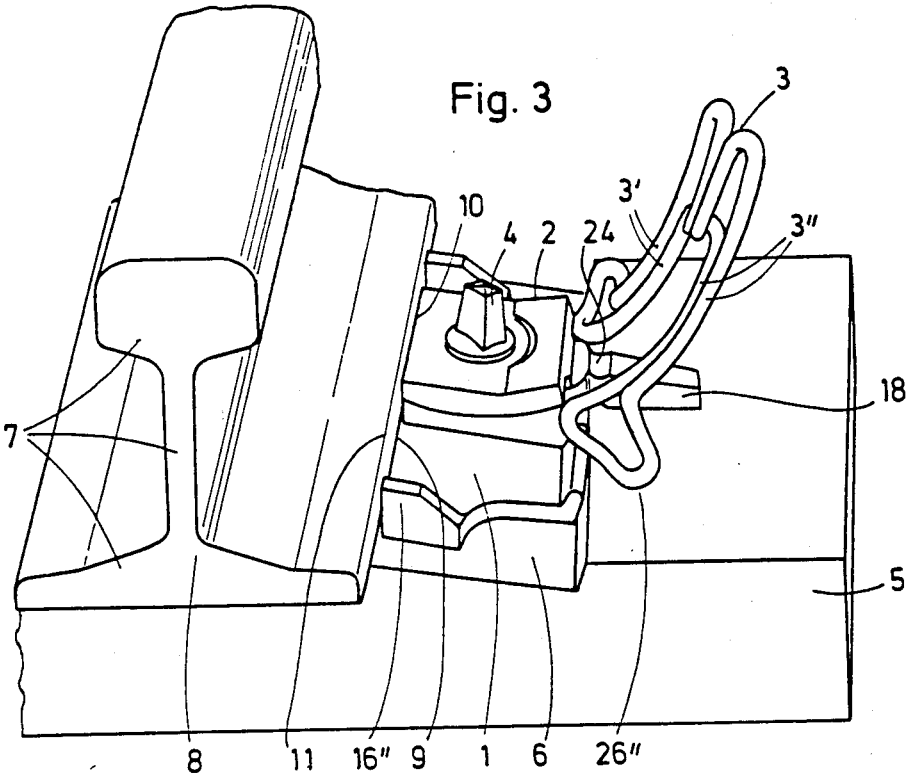
FIG. 3 shows the rail fixing device during insertion of the clamp clip into a pre-assembly position.
Figure 4:
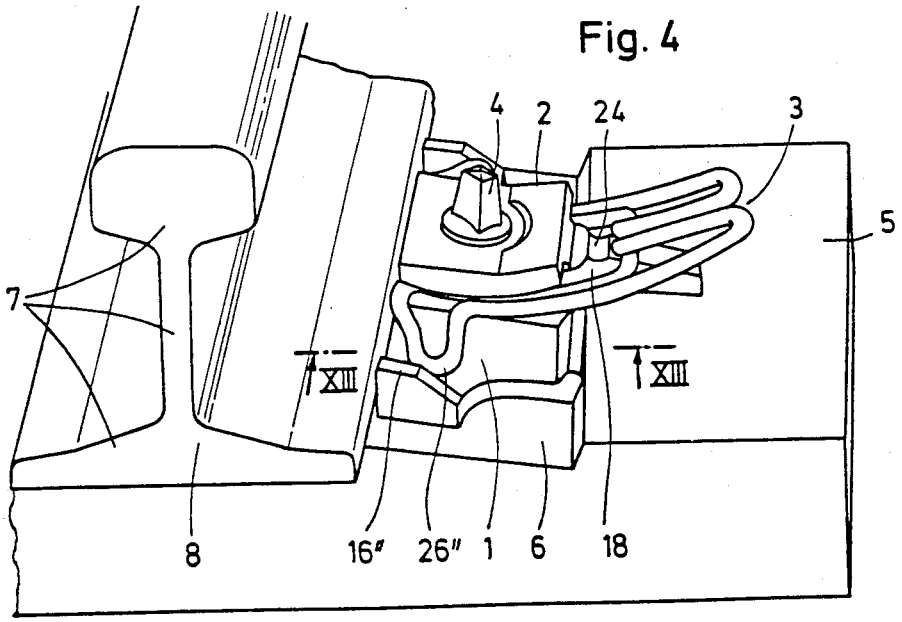
FIG. 4 shows the rail fixing device with the clamp clip in the pre-assembly position.
Figure 5:
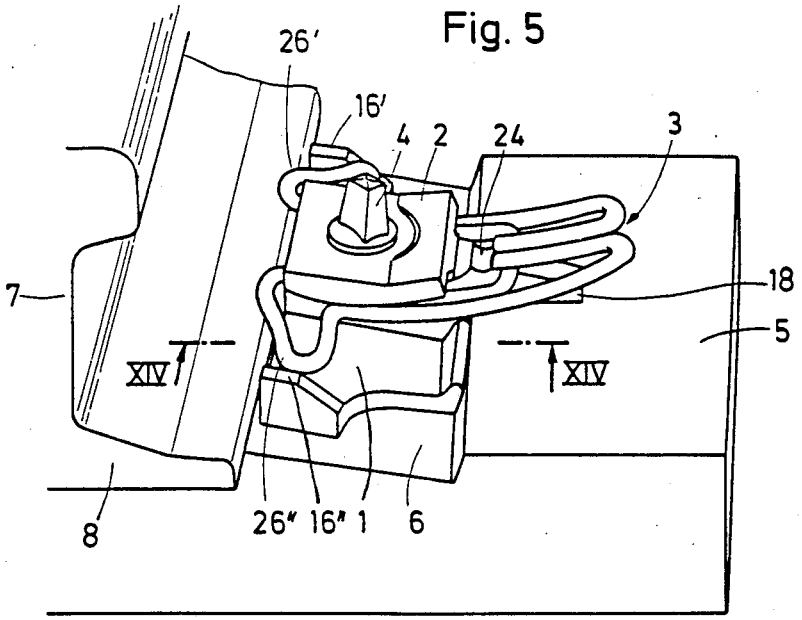
FIG. 5 shows the rail fixing device with the clamp clip in the neutralizing position.
Figure 6:
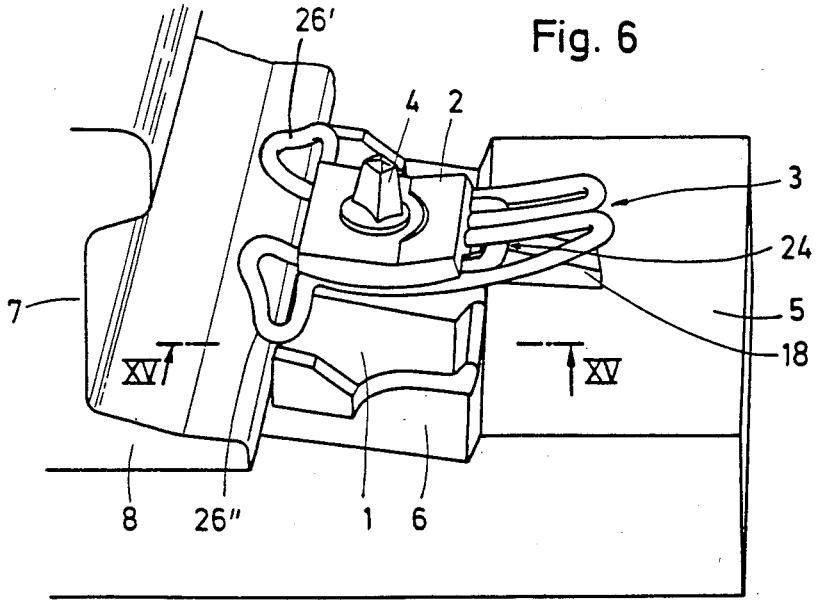
FIG. 6 shows the rail fixing device with the clamp clip in the final bracing position.
Figure 12:
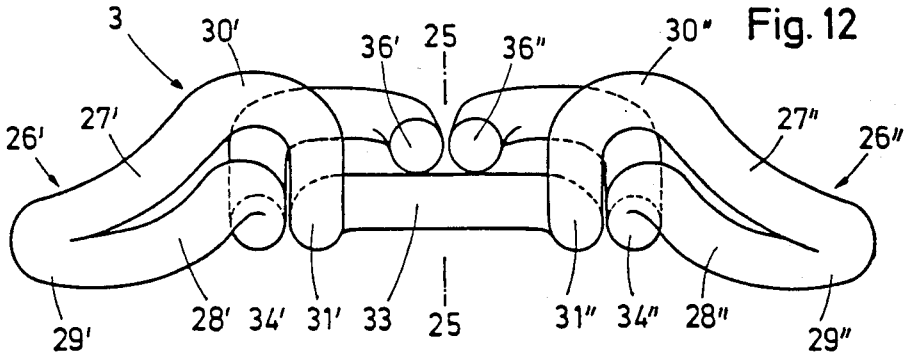
FIG. 12 shows the clamp clip according to FIGS. 10 and 11, seen in the direction of arrow XII.
Figure 13A:
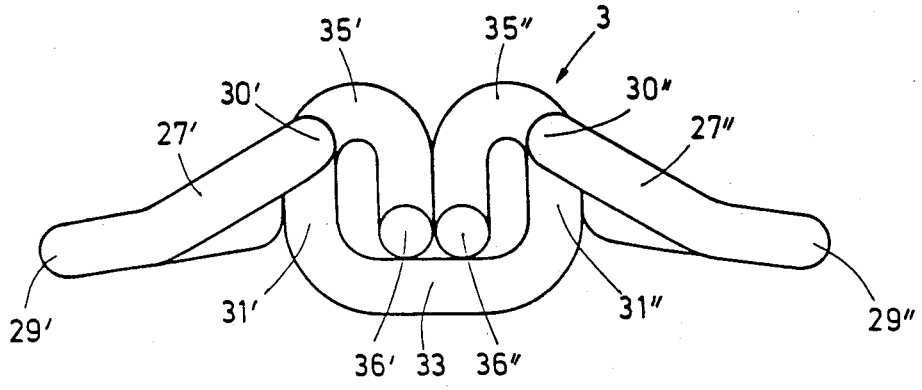
FIG. 13 shows an enlarged cross-section along line XIII—XIII through the rail fixing device according to FIG. 4 with the clamp clip in the pre-assembly position.
Figure 13:
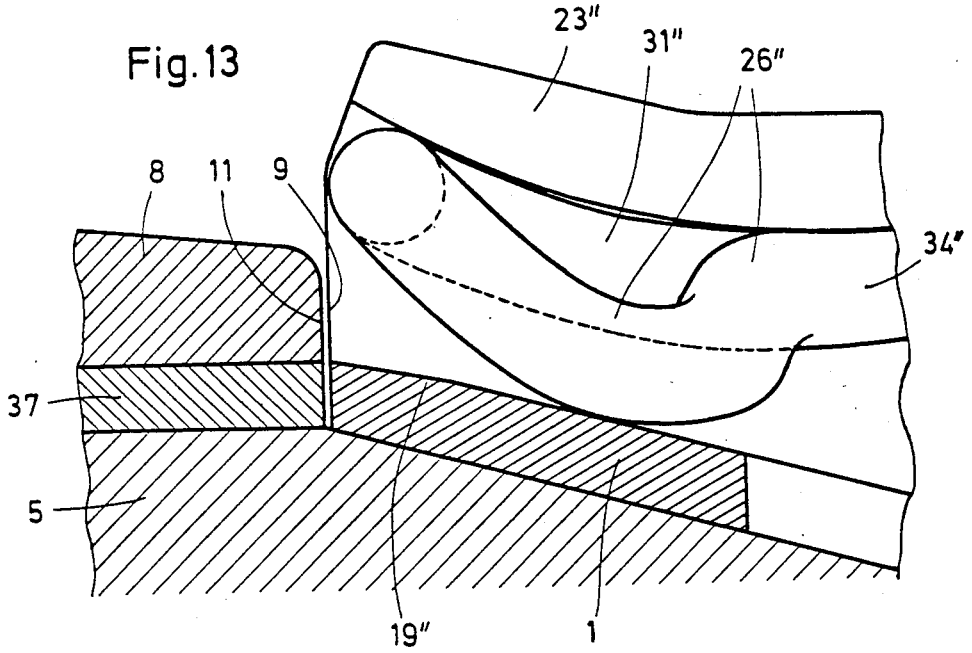
Figure 14:
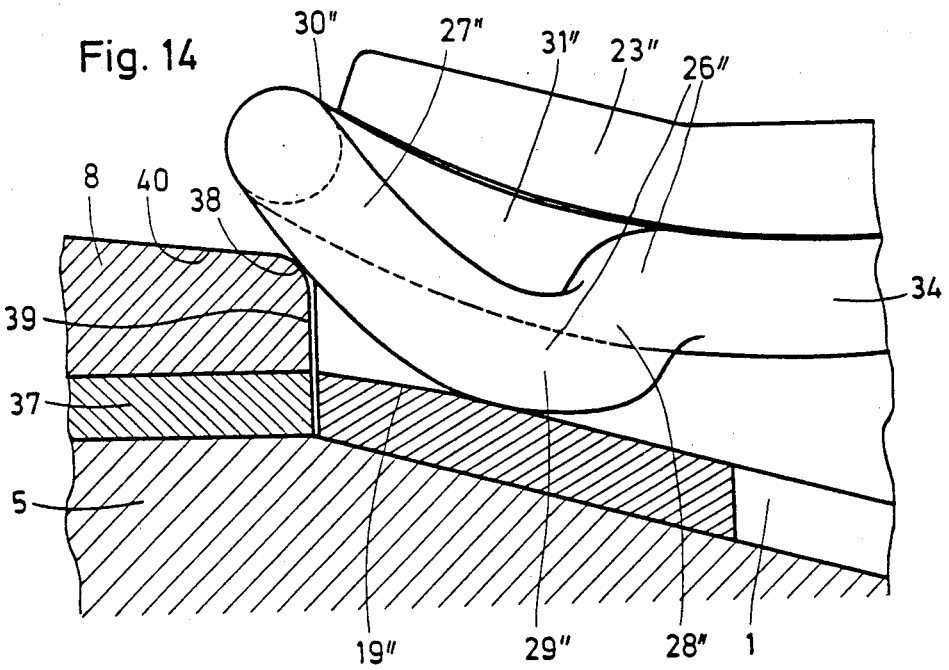
Figure 15:
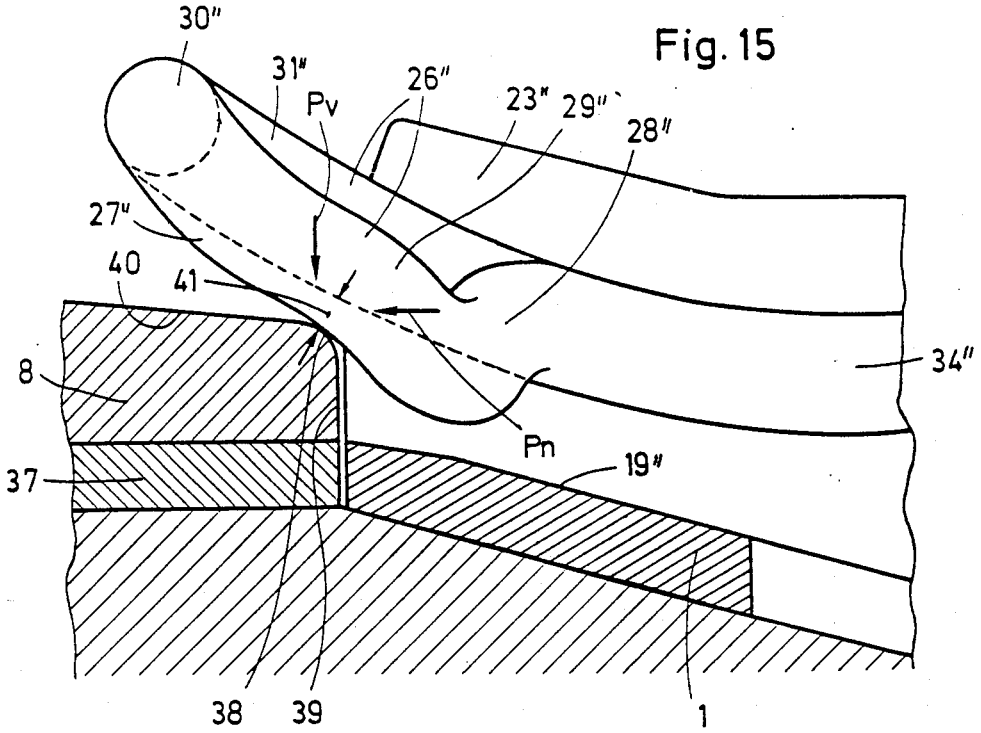
Figure 16:
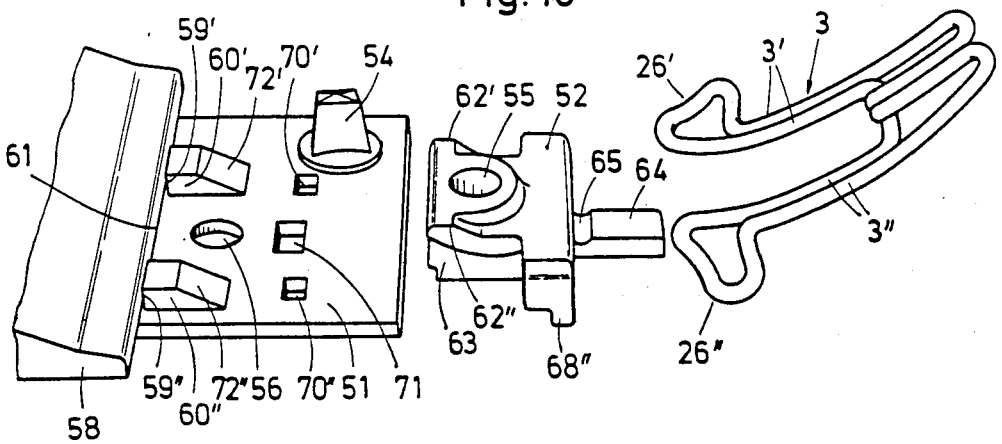
Figure 17:
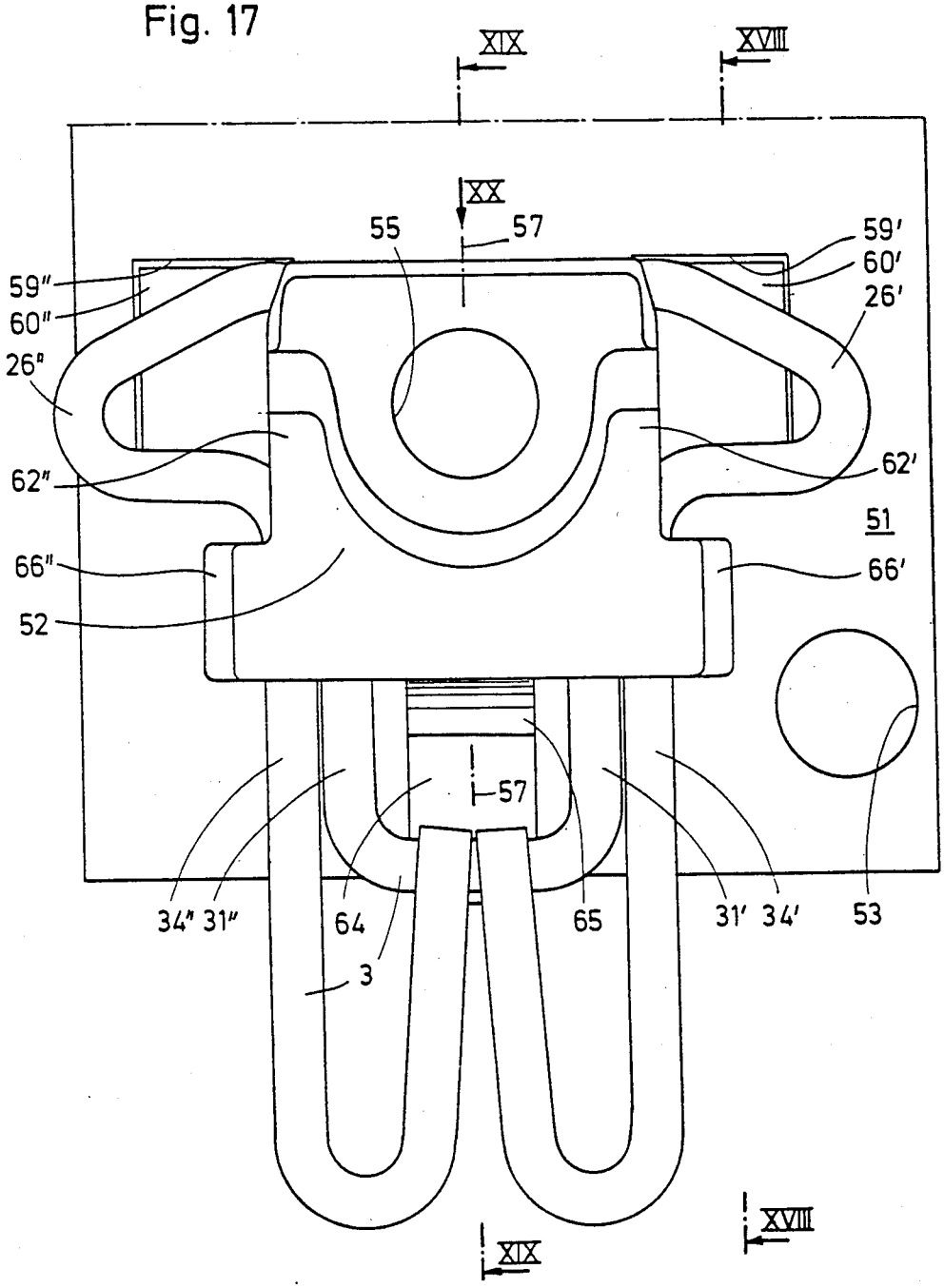
Figure 18:
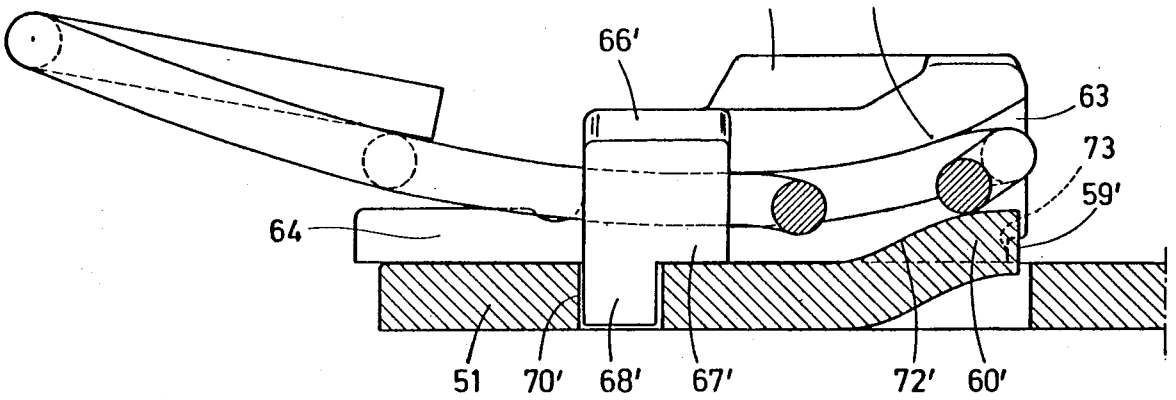
Figure 19:
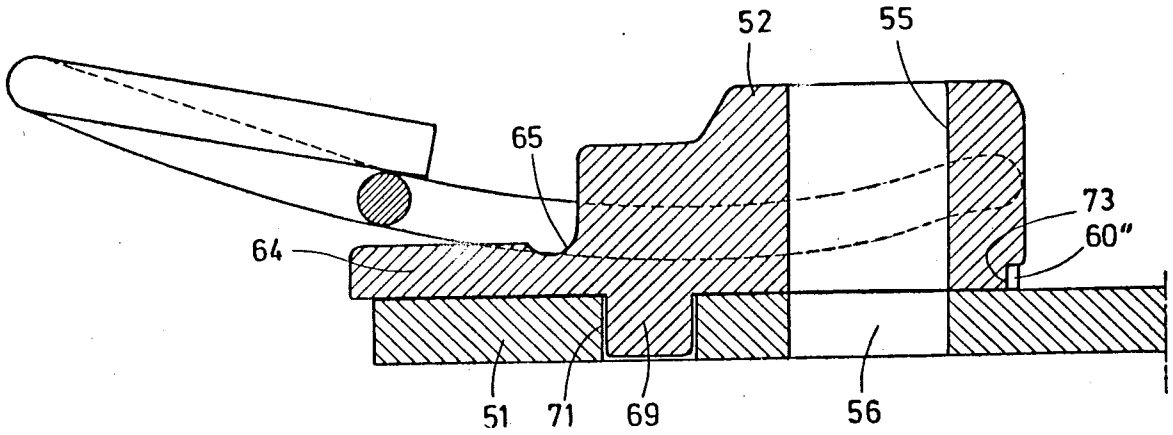

FIG. 13*a* is a view corresponding to FIG. 12 of the clamp clip assigned to the rail fixing device in the pre-assembly position according to FIGS. 4 and 13;

FIG. 14 is an enlarged cross-section along line XIV—XIV through the rail fixing device according to FIG. 5 with the clamp clip in the neutralizing position;

FIG. 15 shows an enlarged cross-section along line XV—XV through the rail fixing device according to FIG. 6 with the clamp clip in the final bracing position;

FIG. 16 is exploded view showing the principal components of another embodiment of a resilient rail fixing device for track installations;

FIG. 17 is a top view showing the rail fixing device according to FIG. 16 with the anchoring head mounted on the base plate and the clamp clip held by the anchoring head in the pre-assembly position;

FIG. 18 shows a section a section along line XVIII—XVIII of FIG. 17;

FIG. 19 shows a cross-section along line XIX—XIX of FIG. 17; and

Figure 20:
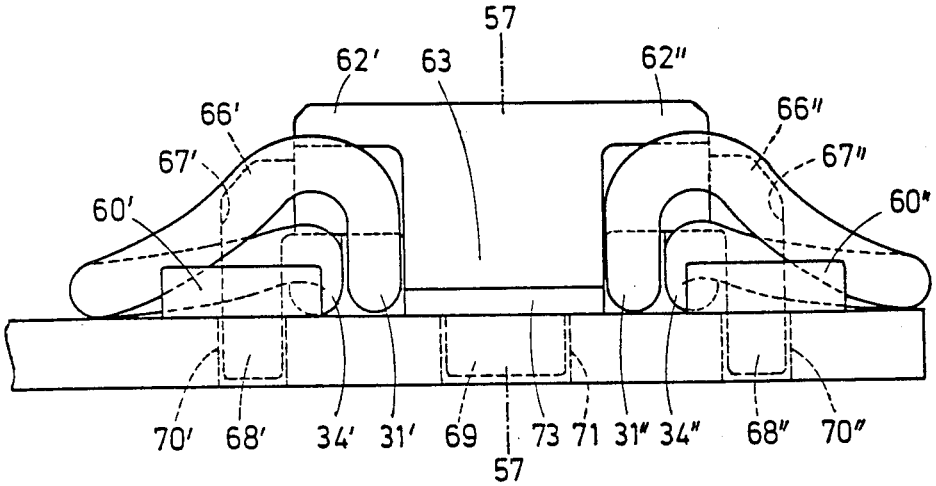

FIG. 20 is a view, seen in the direction of arrow XX, of the rail fixing device according to FIG. 17.

FIGS. 1 to 6 shows a resilient rail fixing device for track installations, which comprises an angle guide plate 1, an anchoring head 2 and a clamp clip 3.

The angle guide plate 1 and the anchoring head 2 are fixed together onto a sleeper 5 by means of a rail screw 4, in the region of wedge-shaped indentation 6 of the sleeper, as can be seen clearly from FIGS. 2 to 6.

The indentation 6 is thus provided in the top of the sleeper 5 in such a manner that it lies, in each case, adjacent to the region of the sleeper 5 which supports the foot 8 of the rail 7. The indentation is designed in such a manner that the inner edge 9 of the angle guide plate 1 and the inner edge 10 of the anchoring head 2 lie directly adjacent to the longitudinal edge 11 of the rail foot 8, as can be clearly seen on FIGS. 2 and 3. The inner edge 9 of the angle guide plate 1 thereby gives the rail 7 the necessary positive lateral hold on the sleeper 5 over the longitudinal edge 11 of its foot 8.

The angle guide plate 1 forms, together with the anchoring head 2, anchoring parts for the clamp clip 3 which acts on the foot 8 of the rail 7 in order to form a non-positive or force-locking resilient rail fixing device with good resistance to twisting.

The anchoring parts formed by the angle guide plate 1 and the anchoring head 2, and also the clamp clip 3 co-operating therewith, are designed symmetrically about a common vertical plane, so that they can be attached to both sides of the rail 7 on the sleeper 5.

The angle guide plate 1 and the anchoring head 2 are preferably produced as cast or forged steel parts. The angle guide plate 1 has on its surface a central web part 12 which is provided with a longitudinal groove 13 and a hole 14 for the rail screw 4. Two support flanges 15′ and 15″ are formed, symmetrically to each other, on both sides of the web part 12, which flanges 15′ and 15″ are provided with an upwardly projecting rim 16′ and 16″ on their lateral edges, formed at least to the front longitudinal edge 9, while upwardly projecting support ledges 17′ and 17″ are formed at right-angles to the central web part 12 on the rear longitudinal edge.

The angle guide plate 1 is provided on its support flanges 15′ and 15″ with inclined surfaces 19′ or 19″ on the front longitudinal edge 9.

The anchoring head also has a central web part 20 on its lower side, through which a hole 21 for the rail screw 4 passes. The central web part 20 is further provided with a downwardly projecting toe 22′, 22″, both in front of and behind the hole 21. These toes 22′ and 22″ have a profile corresponding to the longitudinal groove 13 in the central web part 12 of the angle guide plate 1 and, when the anchoring head 2 is placed on the angle guide plate 1, engage with the longitudinal groove 13, as is clearly seen in FIGS. 7 and 8.

The anchoring head 2 is provided with support flanges 23′ and 23″ which project symmetrically about both sides of its central web part 20, which flanges 23′ and 23″ overlap the support flanges 15′ and 15″ of the angle guide plate 1 with a spacing. This facilitates the insertion of a clamp clip 3 in the manner illustrated in FIGS. 2 to 6.

Figure 7:
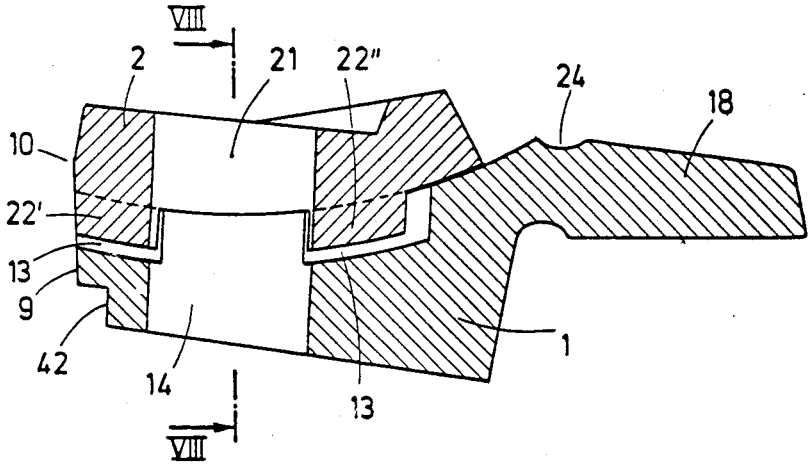
FIG. 7 shows, to scale, a section along line VII—VII of FIG. 1 through the angle guide plate and the anchoring head for the rail fixing device according to FIG. 1 to 6.
Figure 8:
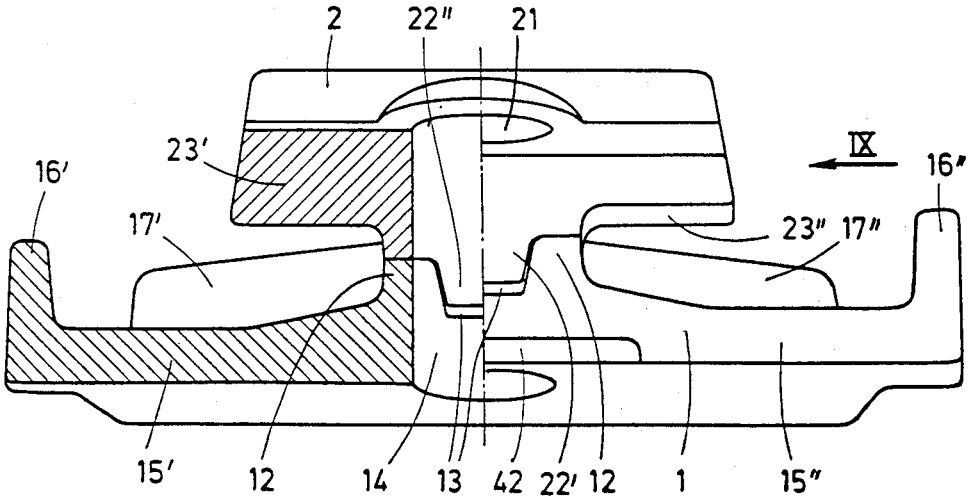
FIG. 8 shows, half as a front view and half as a section along line VIII—VIII of FIG. 7, the angle guide plate and the anchoring head of the rail fixing device according to FIGS. 1 to 6.
Figure 9:
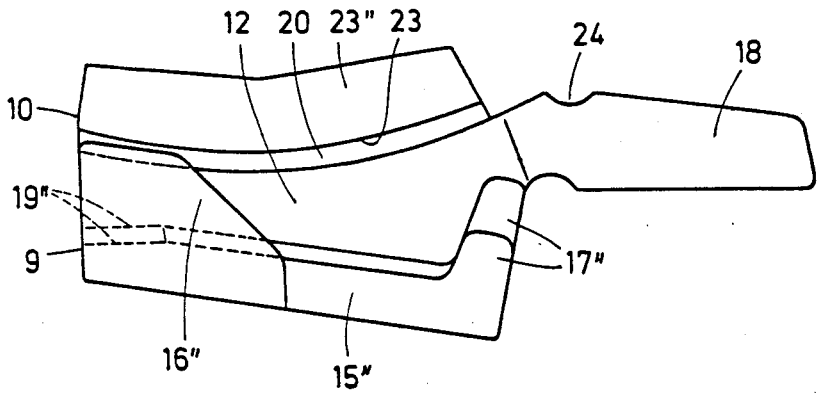
FIG. 9 shows the angle guide plate and the anchoring head of the rail fixing device according to FIGS. 1 to 6, seen in the direction of arrow IX of FIG. 8.

The precise design of the anchoring parts comprising the angle guide plate 1 and the anchoring head 2 is clearly illustrated in FIGS. 7 to 9. FIGS. 7 and 8 clearly show how the toes 22′ and 22″ positively engage on the bottom of the anchoring head 2 into the longitudinal groove 13 in the central web part 12 of the angle guide plate 1. FIG. 9 illustrates more clearly than in FIG. 1 that the top of the support flanges 15′, 15″ is provided with the inclined surfaces 19′, 19″ in the region of the front longitudinal edge 9.

FIGS. 1 to 7 and 9 also shows that an attachment piece 18 is formed integrally with the rear end of the central web part 12 of the angle guide plate 1, on the top of which attachment piece 18 a notch 24 has been made.

Figure 10:
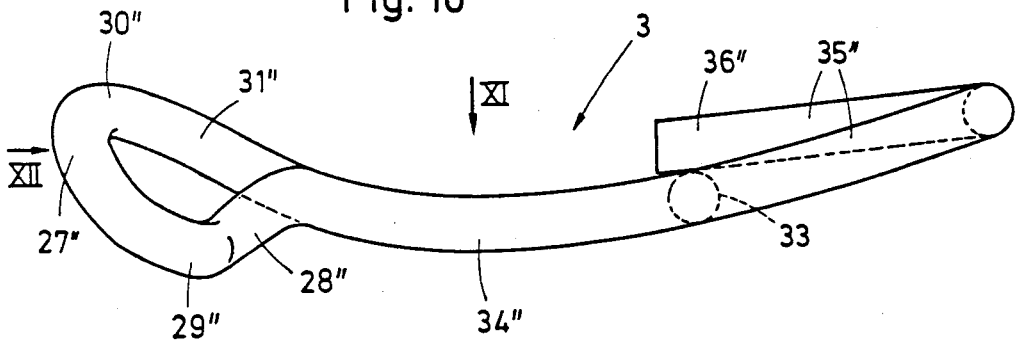
FIG. 10 is a lateral view of the clamp clip of the rail fixing device according to FIGS. 1 to 6.
Figure 11:
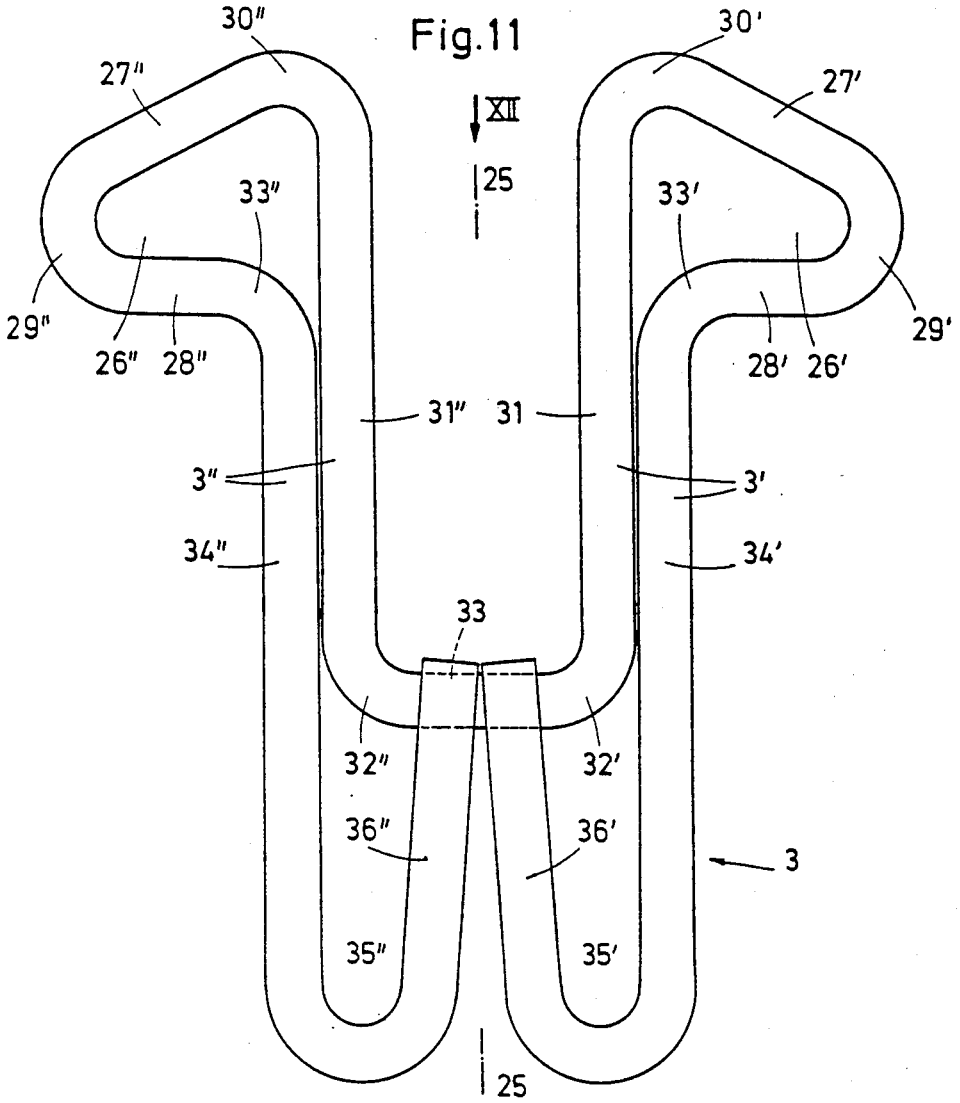
FIG. 11 shows the clamp clip according to FIG. 10, seen in the direction of arrow XI.

The clamp clip 3 which cooperates with the anchoring parts comprising the angle guide plate and the anchoring head 2 to fix the rail 7 is not only shown in FIGS. 1 to 6, but also in more detail in FIGS. 10 to 12. FIGS. 11 and 12 show particularly clearly that the clamp clip 3 is designed symmetrically about longitudinal central line 25—25. It is produced as a flexible formed part of resilient steel rods, which preferably have a round-cross-section, but can also have an oval or polygonal, particularly square, cross-section. The cross-sectional dimensions of the resilient steel rods are such that they can be easily bent when cold.

As can be seen from the drawings, the clamp clip 3 has two bracing sections 26′ and 26″ which are mirror images of each other and are in the form of loops bent outwards and downwards. The loops which form these bracing sections 26′ and 26″ have a triangular shape, as seen in FIG. 11, and are formed by two legs 27′, 28′ or 27″, 28″ with an integral curved section 29′ and 29″ joining them. The legs 27′, 27″ are inclined, as seen in FIG. 11, towards the longitudinal central plane 25—25, while the legs 28' and 28" extend at right angles thereto. This design is of great importance as, on the one hand, the legs 27' and 27" together with the curved sections 30' and 30" guarantee a perfect neutralizing position, as shown in FIG. 14, but, on the other hand, permit the displacement of the clamp clip 3 into its final assembly position according to FIG. 5. The downwards deflection of the clamp clip 3 at the curved sections 30' and 30", which act as bracing segments, can thereby take up a higher position in relation to the curved sections 33' and 33", which also act as bracing segments. The legs 27' and 27" which join the curved sections 29' and 30" or 29" and 30", thus form a leading diagonal, and have a wedge shape when the clamp clip 3 is pushed onto the curves of the rail foot 8.

The loops which form the bracing parts 29' and 29" of the clamp clip 3 extend, in each case, from their legs 27' and 27", via the curved sections 30" and 30", into a resilient rod sections 31' and 31", which then extend parallel to the longitudinal central plane 25—25. Both resilient rod sections 31' and 31" are, moreover, connected together via curved sections 32' and 32" by a transverse piece 33 which runs at right angles to the longitudinal central plane 25—25.

The legs 28' and 28" of the loops which form the bracing parts 29' and 29" are connected integrally to resilient rod sections 34' and 34" via the curved sections 33' and 33", which resilient rod sections 34' and 34" also run parallel to the longitudinal central plane 25—25 and the sides of which lie adjacent to the resilient.rod sections 31' and 31".

The resilient rod sections 34' and 34" extend rearwardly a substantial way beyond the transverse piece 33 between the two resilient rod sections 31' and 31" and then bend inwardly in an approximately U-shape 35' and 35". The free end sections 36' and 36" of each U-shape bend 35' and 35" are inclined towards the longitudinal central plane 25—25 and rest on the top of the transverse piece 33, as can be clearly seen in FIGS. 10 to 12.

FIGS. 1 to 6 and 10 to 12 show that the clamp clip 3 is a relatively complicated form. Not only are the loops which form the bracing parts 26' and 26" bent downwards in the leg regions 27', 27" and 28', 28" which join the resilient rod sections 31', 31" and 34', 34" but their outer curved section 28' and 29" also has an upward bend in relation to the leg regions 27', 27" and 28', 28", as is clear in FIGS. 10 and 12.

The resilient rod sections 31', 31" and 34', 34" of the clamp clip 3 form the abutment leg 3' and 3" when cooperating with the anchoring parts.

It is clear from FIGS. 1 to 6, and more particularly from FIGS. 10 and 12 of the drawings, that these resilient rod sections 31', 31" and 34', 34" are deflected downwards at least over the longitudinal section lying between the bracing parts 26' and 26" and the transverse piece 33. The shape of the clamp clip 3 is such that it can be inserted in the position shown in FIG. 3 into the anchoring parts formed by the angle guide plate 1 and the anchoring head 2. The clamp clip 3 can thereby be pushed into the pre-assembly position without substantial force, as can be seen from the view in FIG. 4 and the lateral view in FIG. 13. With the clamp clip 3 in the pre-assembly position according to FIGS. 4 and 13, it is held on the sleeper 5 by the anchoring parts insuch a manner that, seen from the side of the rail, it has the shape shown in FIG. 13*a*, and the rail 7 can be easily placed from above with its rail foot 8 onto the sleeper 5 or onto an intermediate plate 37 supported by the sleepers. The intermediate layer or plate 37 can be fixed onto the top of the sleeper 5, in the workshop, so that it has laterally projecting noses which engage with a recess 42 arranged on the bottom of the inner edge 9 of the angle guide plate 1, as can be seen from FIGS. 1,7 and 8.

In order that the rail 7 on the sleeper 5 is prevented from lifting, although there is still the possibility of the rail being displaced longitudinally on the sleeper, the clamp clip 3 can be pushed forward, according to FIGS. 4 and 13, into a so-called neutralizing position, as is shown in FIGS. 5 and 14. With the clamp clip 3 in this neutralizing position, the loops which form its bracing sections 26' and 26" overlap the longitudinal edge 11 of the rail 7 with the curved sections 30' and 30" which are joined to the inner resilient rod sections 31' and 31" and with the legs 27' and 27" which again are joined to them. In contrast, the curved sections 29' and 29" and the adjoining legs 28' and 28" still lie in the region of the inclined surfaces 19' and 19" of the angle guide plate 7. In this neutralizing position, the bracing sections 26' and 26" press with a certain prestressing force against the inclined surfaces 19' and 19". The minimal gap in the neutralizing position between the legs 27' and 27" of the clamp clip 3 and the radius of curvature 38 on the rail foot 8 is determined by the curved sections 29' and 29" of the loops which rest on the inclined surfaces 19' and 19" of the angle guide plate 1.

After the rail 7 has been "neutralized", the clamp clip 3 is pushed from the neutralizing position, as shown in FIGS. 5 and 14, into the final assembly position, as shown in FIGS. 6 and 15. In this case, the loops which form the bracing parts 26' and 26" of the clamp clips 3 slide with their outer curved sections 29' and 29" onto the rail foot 8 and are thereby fully raised from the inclined surfaces 19', 19", thereby substantially increasing the prestress. The prestressing force which acts on the radius of curvature 38 of the rail foot 8 is borne by the resilient rod sections 31', 34' and 31", 34" of the clamp clip 3 which lie directly adjacent to each other; these form abutment legs 3' and 3" of the clamp clip which lie on the bottom of the support flanges 23' and 23" and are thus independently stressed to tortion, and therefore act as torsion legs.

The use of the four resilient rod sections 31', 34' and 31", 34" which have been stressed in torsion, as abutment legs 3' and 3" for the clamp clip 3 has the essential advantage that a substantial holding down force can be borne with a weak spring characteristic. The torsional behaviour of the resilient rod sections 31', 34' and 31", 34" and therefore the retroaction on the loops 26, 26" which form the bracing parts is ensured in that they are mutually supported by the co-operation of the transverse part 33 with the end sections 36' and 36" of the U-shaped corners 35' and 35". The end sections 36 and 36" fix the position of the clip 3 in relation to the anchoring parts. The clamp clip 3 and the anchoring parts formed by the angle guide plate 1 and the anchoring head 2 are, in view of their design, matched to each other in such a manner that in the final assembly position of the resilient rail fixing device according to FIGS. 6 and 16, the force is introduced to the rail foot 8 at an angle of incline of about 30° towards the vertical, and with a bracing force of about 1.5 Mp acting on the radius of curvature 38 of the rail foot 8. This then results in a vertical force component $P_y$ of about 1.2 Mp and a horizontal force component $P_h$ which exceeds half the vertical force component $P_v$.

Furthermore, it is important that when the non-positive resilient rail fixing device is in the final bracing position, the resilient rod sections 31' and 31'' of the clamp clip 3 are at a spacing 41 of about 2 mm from the radius of curvature 38 of the rail foot 8 and thus form an overload safety mechanism which prevents the rail 7 from lifting or tilting above the predetermined level under the stresses produced when they are travelled on and simultaneously prevents the clamp clip 3 from stretching excessively.

The clamp clip 3 is prevented from being displaced in the longitudinal direction of the rail 7 in that the loops which form the bracing parts 26' and 26'' lie with their outer curved sections 29' and 29'' relatively close to the upwardly projecting rims 16' and 16'' of the angle plate 1.

It can be seen from FIGS. 2 to 6, and more particularly FIG. 9 and FIGS. 13 to 15, that the bottom of the support flanges 23' and 23'' on the anchoring head 2 is of a shape corresponding to the shape of the resilient rod sections 31', 31'' and 34', 34'' of the clamp clip 3, which act as abutment legs or as torsion legs 3' and 3'', as can be seen from FIG. 10. This ensures that the clamp clip 3 can be made to cooperate with or disengage from the anchoring parts by hand and by mechanical means and therefore can be pushed, with minimal force, into the pre-assembly position, the neutralizing position and the final assembly position. In the final assembly position, the transverse piece 33 of the clamp clip 3 slides onto the tongue-like projection 18 resting on the rear side of the central web part 12 of the guide support plate 1 and is thereby automatically prevented from undesirably moving in its notch 24. The clamp clip 3 and the notch 24 on the tongue-like projection 18 are matched to each other in such a manner that with the clamp clip 3 in the final assembly position, the transverse piece 33 thereof presses into the notch 24 with a supporting force of more than 0.8 Mp.

The particular advantage of a non-positive resilient rail fixing device of the design shown in FIGS. 1 to 15 resides in the fact that the clamp clip 3 can be made to co-operate with or completely disengage from the anchoring parts comprising the angle guide 1 and the anchoring head 2, without the rail screw 4 which serves as the connecting and fixing element having to be loosened. This is particularly important if the clamp clips 3 have to be replaced due to wear or breakage. This design of the clamp clip 3, which is described in detail, has the important effect that the entire force components are separated into four equal portions, i.e. relatively small individual forces, which also demand only relatively small individual cross-sections. The resulting behaviour of the parallel arranged springs makes possible not only the cold shaping of the relatively thin spring wire but also results in the clamp clip 3 having a minimal weight.

A further embodiment of a resilient rail fixing device for track installations is shown in FIGS. 16 to 20. This differs from the design according to FIGS. 1 to 9 only in that the anchoring parts are of a different design, while it uses clamp clips 3 which correspond in their design and function to the clamp clips 3 according to FIGS. 10 to 12 and also operate as shown in FIGS. 13 to 15.

The anchoring parts of the rail fixing device according to FIGS. 16 to 20 have a bearing plate 51 which is relatively thin, for example about 10 mm, and can also be produced as a stamped piece of sheet steel. It is advantageous to deflect this bearing plate 51 by the pressing process by a certain degree, particularly about half its thickness, so that when it is fixed, for example by rail screws, to the sleeper or another rail support point, it can be subjected to a certain degree of prestressing.

The rail foot 58 is placed on the base plate 51, with for example the addition of a suitable intermediate plate, so that the bearing plate 51 projects on both sides by an equal amount over the longitudinal edges 61 of the rail foot 58. Two tongues 60' and 60'' are pressed out of the plane of the base plates 51 directly adjacent to each longitudinal edge 61 of the rail foot 58, which tongues 60' and 60'' face the longitudinal edge 61 of the rail foot 58 with their free front faces 59' and 59'' and thereby ensure the positive lateral hold on the bearing plate 51. The bearing plate 51 is fixed to the sleeper by a rail screw 54 at each of its ends, which rail screw 54 penetrates through a hole 53 (FIG. 17) in the base plate 51 provided for this purpose. The holes 53 are located at the ends of the bearing plates 51 directed away from each other, but in the region of the diagonally opposite corners.

An anchoring head 52 co-operates with the base plate 51, which anchoring head 52 can be fixed using a rail screw (not shown), the rail screw penetrating through a hole 55 in the anchoring head 52 and through a corresponding hole 56 in the bearing plate 51.

The anchoring head 52 is designed symmetrically about a longitudinal central line 57—57, shown in FIGS. 17 and 20. It has, on both sides, a support flange 62', 63 which projects laterally from a central web 62 which extends over the entire length of the anchoring head 52 and ends in an attachment piece 64 projecting backwards which attachment piece 64 has a notch 65 formed in its surface.

The anchoring head 52 has laterally projecting arms 66' and 66'' in the rear region of its support flanges 62' and 62'' which arms 66' and 66'' each support a downwardly oriented web 67' and 67'' with a toe 68' and 68''. The central web is also provided with a downwardly oriented toe 69.

For the purpose of positively fixing the anchoring heads 52 to the base plate 51, the latter has three rectangular or square holes 70', 70'' and 71, with which the toes 68', 68'' , and 69 of the anchoring head 52 engage, as can be seen in FIGS. 18. 19 and 20. The rail screw inserted through the holes 55 and 56 does not only positively connect, without risk of twisting, the anchoring head 52 to the bearing plate 51, but also serves to further secure the bearing plate 51 to the sleeper or to another rail support point.

The tongues 60' and 60'' which are punched out and project from the base plate 51 are at least partially laterally overlapped by the support flanges 62' and 62'' of the anchoring head 52 as can be seen in FIG. 20. These tongues 60' and 60'' therefore do not form just the stops 59' and 59'' for the positive lateral hold of the rail 7 over the longitudinal edge 61 of the rail foot 58, but they are moreover formed in such a manner that they can act as leading inclined surfaces 72' and 72'' which co-operate with the bracing parts 26' and 26'' of the clamp clip 3 which are designed as loops.

The clamp clip 3 in the rail fixing device according to FIGS. 16 to 20 is of the same design as the clamp clip 3 in the rail fixing device according to FIGS. 1 to 9, that is it has all the constructional and functional characteristics which have already been explained with reference to FIGS. 10 to 15. For co-operating with this clamp clip 3, the bottom 62 of the support flanges 62' and 62" of the anchoring head 52 therefore also has a downwardly deflected shape, so that the clamp clips 3 can be placed without difficulty, and with minimal force, in the three functional postions, that is the pre-assembly position (FIG. 13), the neutralizing position (FIG. 14) and the final assembly position (FIG. 15).

As the resilient rod sections 31', 34' and 31", 34" which act as the abutment legs or torsion legs 3' and 3" of the clamp clip 3 are each inserted between the central web 63 and one of the downwardly orientated webs 67' or 67" of the support flanges 62' and 62" when the anchoring head 52 according to FIGS. 16 to 20 is used, it is necessary in order to insert and remove the clamp clip 3, due to wear or breakage, to detach the anchoring head 52 from the bearing plate 51. The simple displacement of the clamp clip 3 is prevented as the webs 67' and 67" of the anchoring head 52 obstruct the laterally projecting bracing parts 26' and 26" of the clamp clip 3 which are in the shape of loops.

FIGS. 17 to 20 show the clamp clip 3 in its position relative to the anchoring parts corresponding to the pre-assembly position, which corresponds in function to FIG. 13. If it is pushed forward into the neutralizing position, it takes up the functional position according to FIG. 14. If it then takes up the final assembly position, its functional position corresponds to FIG. 15.

In order that the clamp clip 3 reliably slides onto the rail foot 58 by means of the surfaces 72' and 72", when it is displaced from the pre-assembly position into the neutralizing position and also from the neutralizing position into the final assembly position, the legs 27', 27" of the loops which form the bracing sections 26' and 26" are designed in such a manner that they are brought into such a high position, owing to the concave deflection of the abutment or torsion legs 3' and 3" of the clamp clip 3 with the curved sections 30' and 30", such that the legs 27' and 27" form a inclined surface between them and the curved sections 29' and 29", which surface may be moved in a wedge-like manner onto the rail foot 58.

We claim:

1. A resilient rail fixing device with good torsional resistance and positive lateral holding properties for track installations with rails having a rail foot on each side of the rail composed of a top surface, a vertical side surface and an interconnecting curved surface, comprising clamp clips and anchoring parts, arranged to each longitudinal curved surface edge of said rail foot on the top of rail support points, said anchoring parts and clamp clips being symmetrical about a common vertical plane transverse to the longitudinal curved surface edges of the rail, each said clamp clip comprising two bracing sections, mirror images of each other, each of which is placed on the rail foot directly adjacent to the anchoring parts, an abutment leg which may be supported on the anchoring parts joined to each of the bracing sections, a transverse piece forming an integral connection between the bracing sections and abutment leg regions of symmetry, and end sections connected to said abutment legs which fix the position of said clip in relation to the anchoring parts; said device when assembled having said bracing sections in contact with said interconnecting curved surface of said rail foot formed at the juncture of the top surface of the rail foot with the vertical outside of the foot, each abutment leg of the clamp clip forming a torsion leg which comprises two approximately parallel adjacent resilient rods, said resilient rods each being connected integrally to a loop which is deflected outwardly and downwardly at a bias to the resilient rods to form said bracing sections, one resilient rod from each torsion leg together forming two inner resilient rods connected to said transverse piece, the one remaining resilient rod from each torsion leg together forming two outer resilient rods and each having a U-shaped deflection with a free end section spaced behind the transverse piece, each deflection resting with its free end section on the transverse piece, said anchoring parts defining two support flanges projecting in opposite directions for supporting said torision legs, a central web joining said flanges, said flanges being arranged to provide spacing adjacent to the curved portion of the rail foot for said bracing sections, and a notched tongue extending from said central web to seat the tranverse piece and hold the device in place after assembling.

2. The rail fixing device according to claim 1, wherein all the resilient rods of the torsion legs of the clamp clip have longitudinal sections and are deflected downwards at least over said longitudinal sections which lie between the loop forming the bracing section and the transverse piece.

3. The rail fixing device according to claim 1, wherein the bracing sections of the clamp clip form loops each deflected downwards in the leg regions joining the resilient rods of the torsion legs while their curved section has an upwardly oriented deflection.

4. The rail fixing device according to claim 1, wherein the loops which form the bracing sections of the clamp clip are approximately triangular in shape and one leg of said triangle extends into the outer resilient rod substantially at right angles to the longitudinal direction of the outer resilient rod, while another leg extends in the longitudinal direction of the inner resilent rod.

5. The rail fixing device according to claim 1, wherein the clamp clips are flexible formed parts of resilient steel rods.

6. The rail fixing device according to claim 1, wherein the free end sections of the U-shaped deflection joined to the outer resilient rods are inclined towards the plane of symmetry of the clamp clip.

7. The rail fixing device according to claim 1, wherein the support flanges of the anchoring parts have at least one deflection on their contact surface for the torsion legs.

8. The rail fixing device according to claim 1, wherein the anchoring parts for the clamp clip comprise an angle guide plate, lying on the top of a rail support point, and an anchoring head which detachably engages positively with the angle guide plate via said central web, the angle guide plate and anchoring head being fixed together by a rail screw.

9. The rail fixing device according to claim 1, wherein the anchoring parts for the clamp clip comprise an angle guide plate, lying on the top of a rail support point, and an anchoring head which is integral with the angle guide plate, the angle guide plate and anchoring head being fixed together by a rail screw.

10. The rail fixing device according to claim 1, wherein said anchoring parts comprise an angle guide plate and an anchoring head, said central web of the anchoring parts comprising a lower web part projecting from said angle guide plate and an upper web part provided below said anchoring head from which toes project, a longitudinal groove being located in the web part of said angle guide plate, in which said toes projecting from the web part of the anchoring head positively engage.

11. The rail fixing device according to claim 1, wherein the anchoring parts comprise an angle guide plate with a central web and the notched tongue for the transverse piece of the clamp clip is formed on the web part of the angle guide plate.

12. The rail fixing device according to claim 1, wherein the anchoring parts comprise an angle guide plate having an approximately T-shaped section and has, at a free end of its web part, upwardly projecting support ledges and upwardly projecting rims at free ends of its flanges, while leading surfaces are provided on the base surface of the flanges adjacent to the web part.

13. The rail fixing device according to claim 1, wherein the anchoring parts comprise an anchoring head and at least one protruding toe with a central web and a bearing plate with at least one recess therein, said anchoring head being fixed in a detachable manner to said bearing plate resting on the top of a rail support point and positively engaging, without risk of twisting, into a recess in the bearing plate a toe located on the anchoring head central web.

14. The rail fixing device according to claim 1, wherein the anchoring parts are in the form of a bearing plate fixed on both sides of the rail by at least one rail screw onto the top of a rail support point, and an anchoring head fixed to the bearing plate by a further rail screw.

15. The rail fixing device according to claim 1, wherein the anchoring parts comprise an anchoring head and a bearing plate having at least one recess, said anchoring head defining support flanges and having arms which project laterally at least in regions on each of said support flanges, each arm supporting a downwardly oriented web with a toe which positively engages, without risk of twisting, into a respective recess in the bearing plate.

16. The rail fixing device according to claim 1, wherein the anchoring parts comprise a bearing plate, said bearing plate being provided on its top with projections which ensure the positive lateral hold of the rail foot, which projections simulataneouly form the leading surfaces for the bracing section of the clamp clip.

17. The rail fixing device according to claim 16, wherein the projections which form the leading surfaces are in the form of tongues which are pressed from and project from the bearing plate.

18. The rail fixing device according to claim 1, wherein the anchoring parts comprise an anchoring head, said anchoring head having a downwardly oriented deflection which serves to produce a prestressing force.

19. The rail fixing device according to claim 1, wherein the anchoring parts comprise an anchoring head, said notched tongue for the transverse piece of the clamp clip being formed on the anchoring head.

20. The rail fixing device according to claim 1, wherein the anchoring parts comprise an anchoring head having said central web and said notched tongue for the transverse piece of the clamp clip.

21. The rail fixing device according to claim 1, wherein the anchoring parts comprise an angle guide plate, said angle guide plate having a recess on the bottom of an inner edge, which recess forms a support contact for an intermediate layer placed on a rail support point.

22. The rail fixing device according to claim 1, wherein the anchoring parts comprise an anchoring head with said central web, said anchoring head having a recess on the bottom of the surface of the central web facing the rail foot, which recess forms a support contact for an intermediate layer lying on the bearing plate.

* * * * *